US006106150A

United States Patent [19]

Lindholm et al.

[11] Patent Number: 6,106,150

[45] Date of Patent: Aug. 22, 2000

[54] METHOD AND APPARATUS FOR MEASURING THE MELT TEMPERATURE IN A MELT VESSEL

[75] Inventors: Ragnar Lindholm, Bromma; Mikael Thorén, Djursholm, both of Sweden

[73] Assignee: SinterCast AB, Stockholm, Sweden

[21] Appl. No.: 09/125,834

[22] PCT Filed: Feb. 24, 1997

[86] PCT No.: PCT/SE97/00304

§ 371 Date: Aug. 26, 1998

§ 102(e) Date: Aug. 26, 1998

[87] PCT Pub. No.: WO97/31248

PCT Pub. Date: Aug. 28, 1997

[30] Foreign Application Priority Data

Feb. 26, 1996 [SE] Sweden ..... 9600720-8

[51] Int. Cl.[7] ..... G01K 1/12; G01K 1/08; G01K 1/04

[52] U.S. Cl. ..... 374/139; 374/121; 374/140; 374/157

[58] Field of Search ..... 374/139, 140, 374/157, 121; 73/DIG. 355, DIG. 9

[56] References Cited

U.S. PATENT DOCUMENTS

| | | | |
|---|---|---|---|
| 3,446,074 | 5/1969 | Thomas | 73/355 |
| 3,570,277 | 3/1971 | Dorr et al. | 73/355 |
| 3,626,758 | 12/1971 | Stewart et al. | 73/355 |
| 3,747,408 | 7/1973 | Stanworth et al. | 73/355 |
| 4,002,069 | 1/1977 | Takemura et al. | 374/140 |
| 4,216,028 | 8/1980 | Kurita | 136/234 |
| 4,444,516 | 4/1984 | Dostoomian et al. | 374/131 |
| 4,568,199 | 2/1986 | Schmidt | 374/122 |
| 4,995,733 | 2/1991 | Thomas et al. | 374/140 |
| 5,037,211 | 8/1991 | Nakashima et al. | 374/139 |
| 5,577,841 | 11/1996 | Wall | 374/140 |
| 5,733,043 | 3/1998 | Yamada et al. | 374/140 |
| 5,839,830 | 11/1998 | Young et al. | 374/140 |

*Primary Examiner*—G. Bradley Bennett
*Assistant Examiner*—Gail Verbitsky
*Attorney, Agent, or Firm*—Pillsbury Madison & Sutro LLP

[57] ABSTRACT

A method for measuring the melt temperature in a melt vessel, where the vessel wall, at least partially, is made of a material transparent for infrared light; said material, at the interior of the vessel, is coated with a material having a high and stable emission factor (e>0.5; de/dT<0.001); the temperature of the inside of the vessel wall is used as a measure of the melt temperature close to the wall; and said temperature at the inside of the vessel wall is measured by use of optical pyrometry applied from the outside of the melt vessel.

13 Claims, 4 Drawing Sheets

METHOD AND APPARATUS FOR MEASURING THE MELT TEMPERATURE IN A MELT VESSEL

This application is the national phase of international application PCT/SE97/00304, filed Feb. 24, 1997 which designated the U.S.

The present invention relates to a method for measuring the melt temperature in a melt vessel by using optical pyrometry.

In the foundry industry it is often desirable to be able to determine in which matrix structure a certain molten metal alloy will solidify. One way of carrying out such determinations is to perform a thermal analysis of the melt. A small but representative sample of the molten metal alloy is taken and is allowed to solidify. During this process, the temperature is measured as a function of time. The final matrix structure is then determined by comparing the obtained cooling curve and its time derivative with reference curves. Such thermal analysis methods are disclosed in e.g. WO86/01755 (SC101), WO91/13176 (SC108) and WO92/06809 (SC104).

In the above mentioned method, a sample of molten metal is obtained by immersing the sample vessel into the bulk metal after which said sample is allowed to solidify. The thermal analysis is performed by using temperature responsive means, normally thermocouples. In order to improve the accuracy of the solidification analysis, WO 86/01755 teaches a method in which two thermocouples are used. One thermocouple is positioned in the centre of the vessel and the other near the vessel wall.

It is often difficult to perform accurate temperature measurments close to the wall of the sample vessel. The physical dimensions of thermocouples require that they be located at least 1.5 mm away from the wall to ensure that the molten iron can flow between the thermocouple tip and the vessel wall. Due to the presence of insulation surrounding the tip of the thermocouple (to protect the hot junction), the practical result is that the "wall" temperature is actually being measured at a location which is more than 2 mm away from the wall itself.

This constitutes a limitation to WO 86/01755, since it is known that the most accurate measurement of the undercooling of a melt is measured directly from the wall itself, where the iron first begins to solidify. The displacement of the conventional thermocouple from the wall surface results in the bulk-metal behavior influencing the temperature registered by the thermocouple and detracts from the accuracy of the measurement. Furthermore, the thermocouple itself constitutes both a heat sink and a wall surface which can influence the solidification behaviour relative to a pure sample.

Sometimes, it is desirable to at least partially coat the wall of the sample vessel with certain chemicals affecting the solidification behavior of the melt. Then, in order to thermally investigate the influence of the coatings on the melt, it is also necessary to be able to measure the temperature close to the wall and not 1–2 mm from the wall. If the measurements are performed too far away from the wall, the coatings can become diffused or diluted and hence, the thermal analysis will not have the required accuracy.

Also, because of the opaqueness of the molten metal, it is not possible to ensure that the thermocouple is reproduceably arranged in each sampling vessel. Another drawback of conventional thermal analysis using thermocouples is that the immersion thermocouples are destroyed during the measurements and hence, they can only be used once. In order to perform accurate measurements which can be reliably compared to reference values, it is necessary that the quality of the consummable thermocouples is very uniform. The destruction of these uniform quality thermocouples during measuring results in high costs. Furthermore, the avoidance of consumable thermocouples simplify the recycling of the sample vessel.

Consequently, there is a need for improved methods for carrying out the thermal analysis procedure.

EP-A2-0 160 359 relates to an apparatus for measuring the bath temperature of metallurgical furnaces through a tuyere. A periscope is used for inserting a fiber optic cable into a tuyere body. The cable is protected from the molten metal by letting air flow through the tuyere and out in the bath.

EP-A2-0 245 010 describes a submersible probe for a single measurement of the temperature of molten metal covered with a layer of semiliquid or liquid slag.

EP-A1-0 655 613 discloses a temperature measuring device including an optical fibre, a metallic protective tube for covering the optical fibre, and a heat insulation coating for covering the protective tube.

These documents are all focused on bulk temperature measurements in large batches of molten metal in order maintain the temperatures at suitable levels before casting. None of the documents disclose anything about a) an accurate location of a measuring point;
b) the ability of measuring at the wall instead of 2 mm away, where bulk-metal effects can influence the measurement;
c) the ability of accurately measuring wall reactions which are imposed by placing certain chemicals on the walls; or
d) the ability to provide stable and reliable temperature readings throughout the solid-to-liquid transformation of the molten iron.

The documents neither disclose anything about pyrometric measurements through a transparent vessel in general, nor about measurements in a small sample vessel.

SUMMARY OF THE INVENTION

Now, it has turned out that the above mentioned drawbacks relating to thermal analysis of molten metals can be overcome by at least partially using optical pyrometry instead of conventional thermocouples. In the method according to the present invention a) the wall of the sample vessel is at least partially made of a material transparent for infrared light;
b) said transparent vessel wall material is, at the interior of the vessel, coated with a material having a high and stable emission factor ($e>0.5$; $de/dT<0.001$);
c) the temperature of the inside of the vessel wall is used as a measure of the melt temperature close to the wall; and
d) said temperature at the inside of the vessel is measured by using optical pyrometry applied from the outside of the melt vessel.

The present invention also relates to an apparatus for carrying out the above mentioned method, as well as the use of optical pyrometry for performing thermal analysis of metal melts.

DETAILED DESCRIPTION OF THE INVENTION

The present invention relates to a method for measuring the temperature and solidification behaviour of a molten metal by using pyrometry. Pyrometers have previously been used for measuring the temperature of molten metals. The application herein constitutes an improvement in the accuracy of thermal analysis and thus allows more information to be obtained.

The method according to our invention is based on the use of a sample vessel, wherein the wall of said vessel is made of a material such as quartz (with a sufficient purity to prevent thermal shock or cracking ) which is transparent for infrared light. The inside of said vessel wall is coated by a material having a high and stable emmision factor. Examples of such coatings include ceramic materials, in particular comprising at least one of alumina, magnesia, mullite, zircon, titanium nitride, boron nitride or mixtures thereof.

Figure 2:
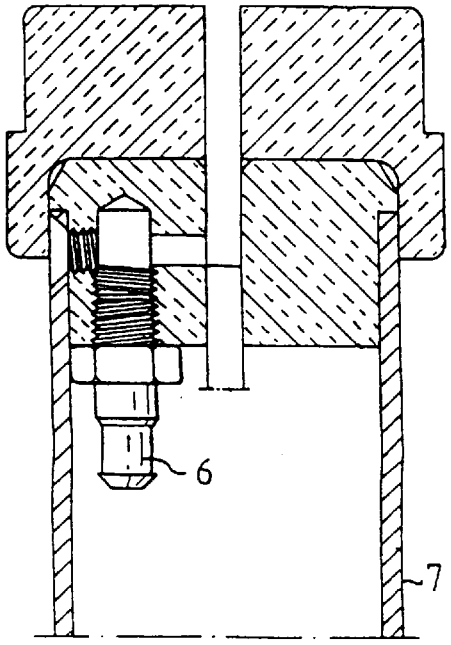
Figure 3:
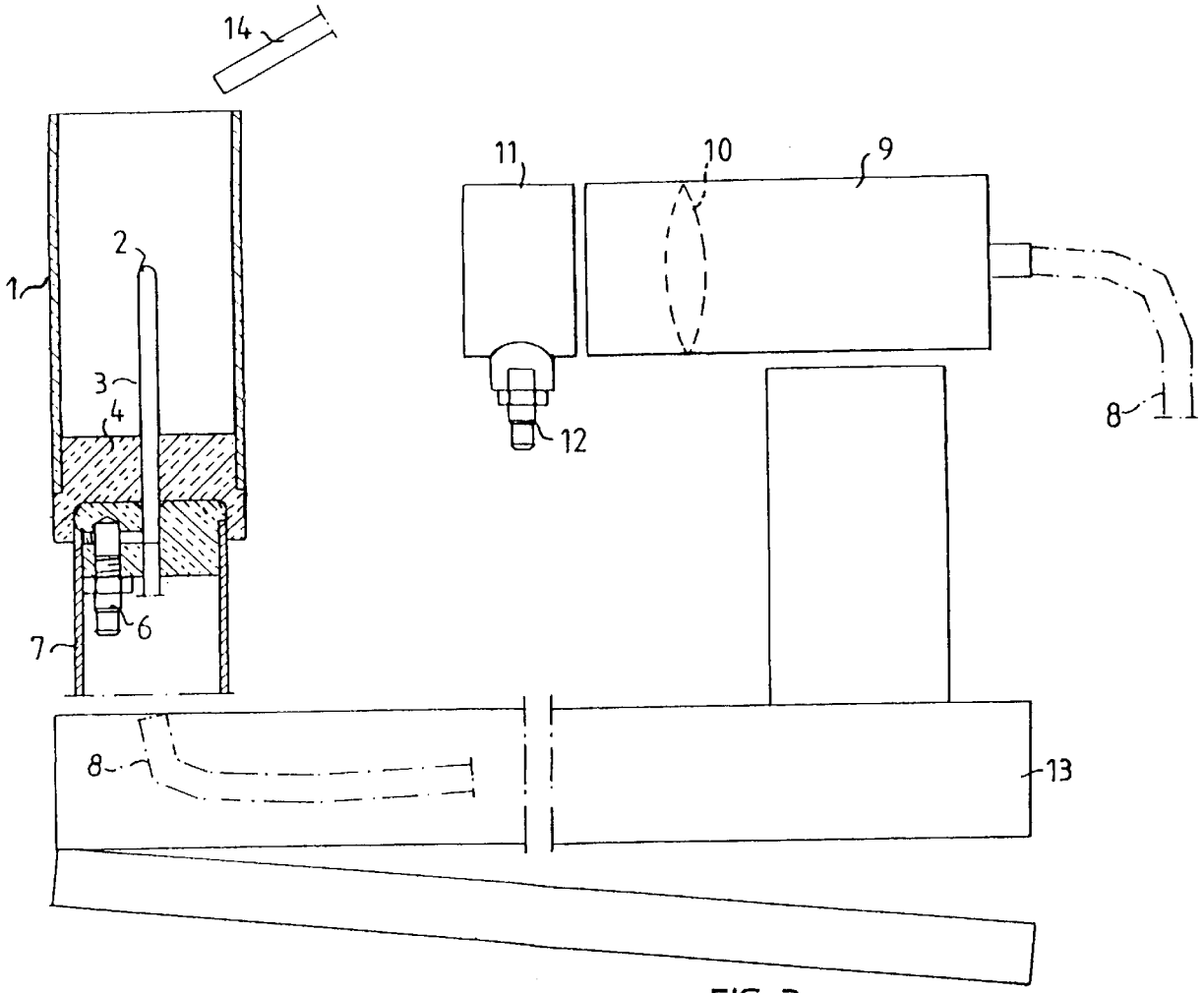
Figure 4:
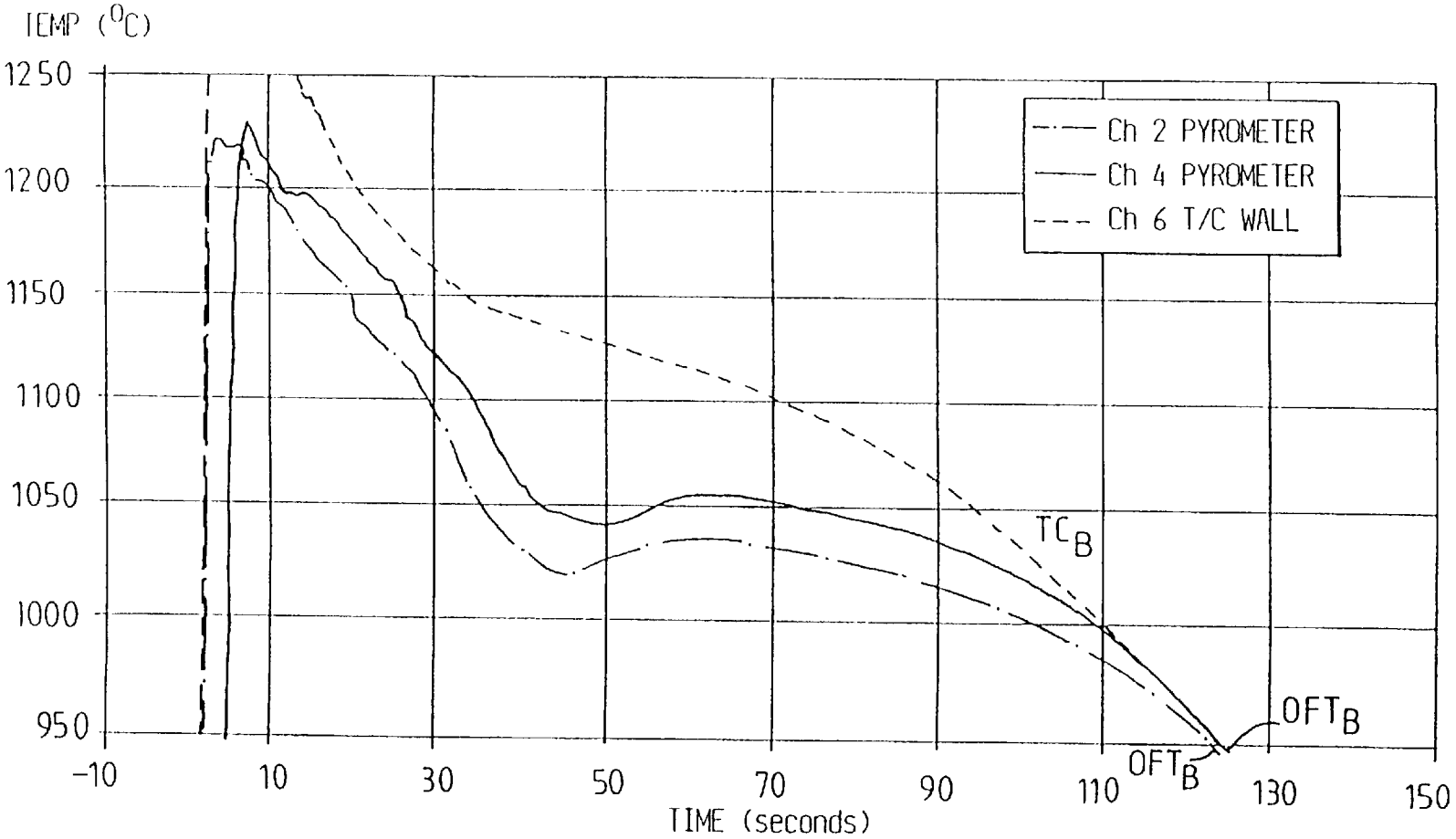
Figure 5:
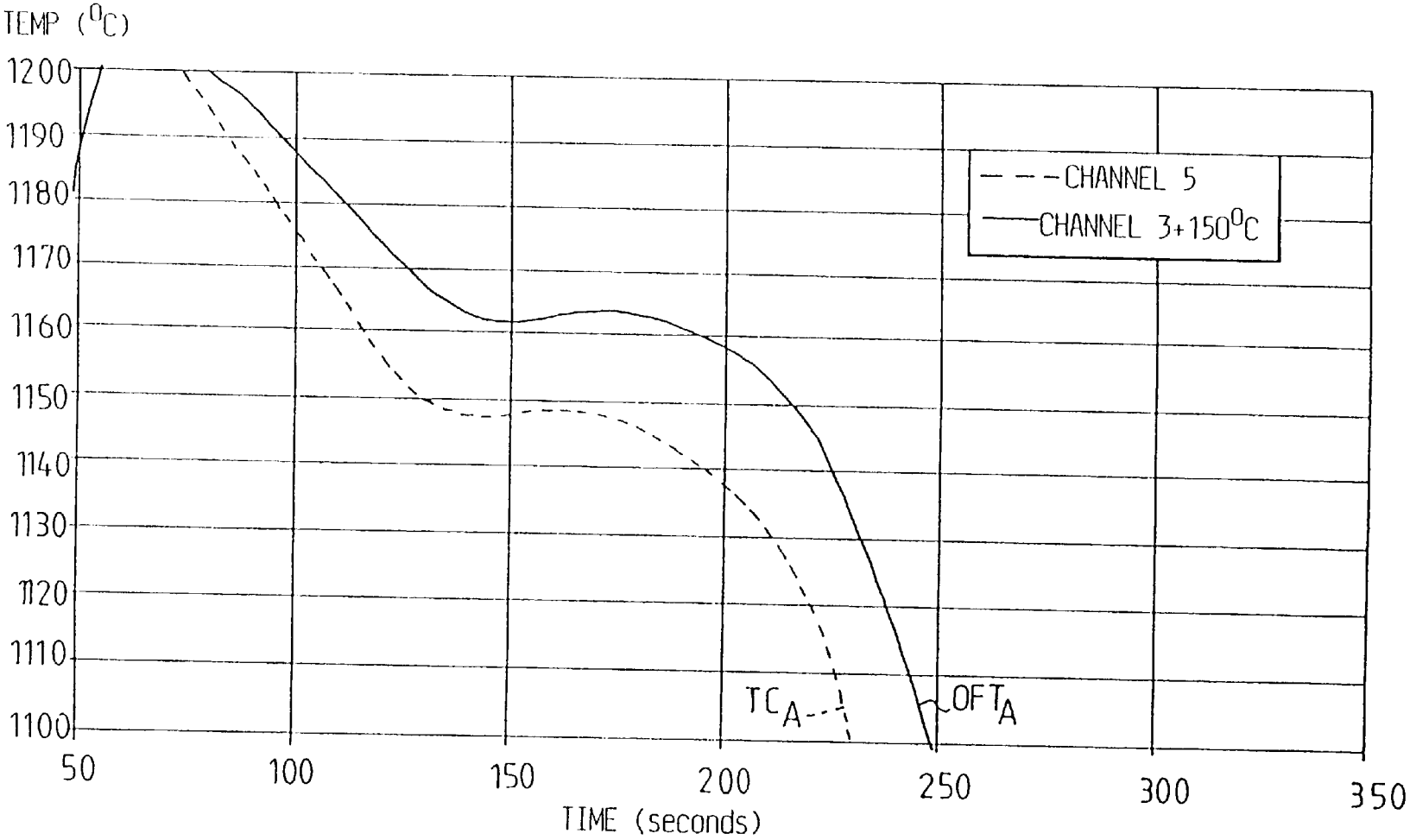

The invention will now be described with reference to the accompanying figures, in which FIG. 1 relates to a longitudinal section of a sample vessel that can be used in the method according to the invention;

FIG. 2 shows a longitudinal section of a connection device that is suitable for connecting the light conductor to the pyrometer;

FIG. 3 discloses a complete set-up for carrying out the method according to the invention;

FIG. 4 shows a set of three cooling curves obtained from the wall region of a sample vessel according to the present invention, where two of the curves have been obtained by pyrometric measurements and the remaining curve has been obtained by using a standard immersion thermocouple; and FIG. 5 discloses a set of two cooling curves obtained from the centre of a sample vessel according to the present invention, where one curve has been obtained by pyrometric measurements and the other by using a standard immersion thermocouple.

Figure 1:
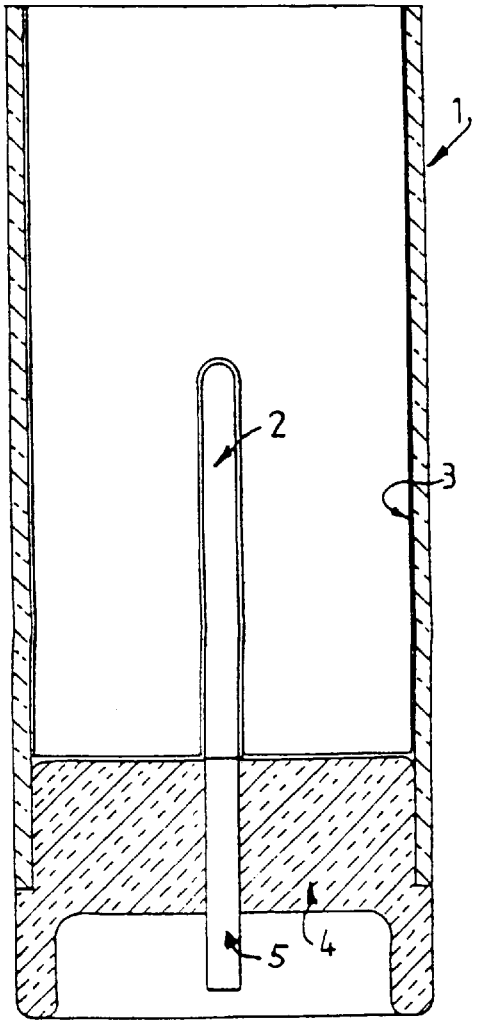

FIG. 1 shows an example of a sample vessel that can be used in the present invention. The material of the vessel wall (1) is transparent for infrared light, and is preferably quartz or fused silica. The inside of the wall (1) is coated by a ceramic material (3) having a high and stable emission factor, such as alumina, magnesia, mullite, zircon, or mixtures thereof.

The measured temperature is actually the temperature of the coating (3) and not the temperature of the melt, but the coating temperature is in reality a measurement of the melt temperature close to the wall. By using such a sample vessel, the problem of arranging a thermocouple in connection with measuring the melt temperature directly at the sample vessel wall is eliminated.

In order to measure the temperature in the centre of the sample vessel, a technique similar to the one used for measuring close to the wall can be used. The sample vessel in FIG. 1 is equipped with a centrally located quartz guide rod (2) which is coated in the same way as the sample walls (1). The rod is preferably made of the same infrared light transparent material as the rest of the sample vessel and can be equipped with a centrally placed cavity where a waveguide such as an optical fiber can be inserted.

FIG. 2 shows an example of a connection device that is used to connect the centrally placed light conductor (2) of the sample vessel in FIG. 1. The device comprises a clutch sleeve (4), a connecting fiber (5) partially going through the central opening of the clutch sleeve (4). The connecting fiber (5) is attached to the pyrometric detection equipment. The clutch sleeve has an air channel (6) by which clean air is continuously delivered, thus creating an air barrier which prevents particles from penetrating the connecting fiber (5).

FIG. 3 discloses an example of a complete set-up for carrying out the present invention. A device corresponding to the connection device in FIG. 2 has been mounted in front of the wall pyrometer (9). This equipment is called an "air purge" and protects the lens (10) of the pyrometer (9) from particles by creating an air barrier. Clean air is continuously delivered though an air junction (12). The pyrometer is connected by an optical fiber (8) to the sample vessel (1).

In order to prevent metal from blocking or blackening the wall of the same vessel (1) facing the pyrometer (9), the sample vessel (1) and the support (13) has been tilted some degrees in the opposite direction from the pyrometer (9). The result is that metal flowing over by mistake will run towards the opposite side and hence, not disturb the pyrometer (9). For the same reason, a protective plate (14) has been mounted above the sample vessel. Alternatively, the plate can be designed as a funnel.

FIG. 4 discloses a set of three cooling curves obtained from the wall region of the above described sampling vessel. The labelling of the curves is explained as follows:

$TC_B$ The standard immersion thermocouple located adjacent to the wall; and $OFT_B$ Optical fiber pyrometer temperature obtained at the wall of the transparent sample vessel.

The first item to be noted in FIG. 4 is the difference in the absolute temperature level for the three curves. The level shown in the curve of $TC_B$ is correct while the pyrometer curves (Ch.2 and Ch.4 pyrometer) are too low. This is simply a calibration effect and an appropriate constant temperature calibration factor could easily be added to the two pyrometer curves to bring all three curves to the same temperature level. This calibration activity is well-known to persons skilled-in-the-art.

The second item, of greater metallurgical significance, is that the two pyrometer curves show a clear minimun temperature (at approximately 45 seconds) followed by a recalescence and maximum. The conventional immersion thermocouple does not exhibit this behaviour because the quartz sample cup loses heat so rapidly from the wall region that the immersion thermocouple is not sufficiently responsive to detect the latent heat of solidification. Ultimately, the comparison of the three curves shows that the pyrometer temperature measurement is more sensitive than the immersion thermocouple, and that this new concept has improved response-time and resolution relative to conventional thermocouples to provide the critical solidification data referred to in WO86/01755 and, although not shown here, WO92/06809.

It should also be noted that the pyrometer curves shown in FIG. 4 have not been subjected to any data conditioning and therefore not yet "smoothened".

Similar to FIG. 4, the set of cooling curves in FIG. 5 compares conventional immersion thermocouple (TCA) and the optical fiber pyrometer ($OFT_A$), however, this comparison is effected at the center of the sample vessel. Once again, the two curves are separated by a constant calibration factor, which could easily be added to adjust the pyrometer data. Unlike the curves presented in FIG. 4, the pyrometer data has, in this case, been conditioned and therefore the curve is "smooth" and ready for analysis including correct determination of minima, maxima and cooling rate slopes. It is also interesting to note that both curves show a minimum (at approximately 140 seconds) and a recalescence to a maximum. This is because the rate of heat loss at the centre of the sample is lower than that at the wall and therefore the immersion thermocouple also has sufficient response capability to detect the latent heat of solidification. Current thermal analysis techniques lack the ability to determine minor thermal anomalities such as austenite precipitation or the exact onset of the eutectic reaction. The described method provides an entirely new thermal information which will undoubtedly improve the value of thermal analysis.

As shown in these diagrams, the infrared pyrometric temperature sensing is a powerful technique which offers improved sensitivity, response time and accuracy. Of course, it also eliminates the consumption of costly immersion thermocouples and probe assembly time.

What is claimed is:

1. A method of measuring a melt temperature of a melt in a sample vessel, comprising:

providing a sample vessel having a wall, the wall having at least a portion which is substantially transparent to infrared radiation, and having an interior wall surface comprising a material having an emission factor meeting the conditions:

$$e>0.5 \quad (1)$$

and $$de/dT<0.001 \quad (2)$$

wherein e is an emission factor and de/dT is a derivative with respect to time of the emission factor;

providing a melt contained within the sample vessel;

providing an optical pyrometer, disposed outside the sample vessel; and measuring the melt temperature of the melt at the interior wall surface, using the optical pyrometer.

2. A method of measuring a melt temperature according to claim 1, further comprising:

providing at least one thermocouple disposed substantially at a center of the melt in the sample vessel; and measuring a temperature with the thermocouple.

3. A method of measuring a melt temperature according to claim 1, further comprising:

providing a guide rod having one end positioned at a measuring point located substantially at a center of the melt in the sample vessel and a second end disposed outside of the sample vessel, the guide rod acting to transmit infrared radiation from the measuring point to a pyrometric measuring device.

4. A method according to claim 3, wherein the guide rod is at least partially coated with a material meeting the following two conditions:

$$e>0.5 \quad (1)$$

and $$de/dT<0.001 \quad (2)$$

wherein e is an emission factor and de/dT is a derivative with respect to time of the emission factor.

5. A method according to claim 1, wherein the coating comprises a ceramic material selected from the group consisting of: alumina, magnesia, mullite, zircon, titanium nitride, and boron nitride.

6. A method according to claim 1, wherein the melt is a metal melt.

7. A method according to claim 6, wherein the metal melt is a compacted graphite cast iron melt.

8. A method according to claim 1, further comprising:

providing the vessel with at least one guide rod having a first end disposed at a measuring point substantially at a center of the melt in the sample vessel and a second end disposed outside the sample vessel, that portion of the guide rod disposed within the vessel being coated with a material meeting the following two conditions:

$$e>0.5 \quad (1)$$

and $$de/dT<0.001 \quad (2)$$

wherein e is an emission factor and de/dT is a derivative with respect to time of the emission factor.

9. A method according to claim 1, further comprising, using the measured temperatures to perform thermal analysis of the melt.

10. A sample vessel for thermal analysis of a melt, comprising:

a side wall;

a bottom wall attached thereto such that the bottom and side walls can contain the melt;

at least a portion of at least one of the walls of the vessel comprising a material which is substantially transparent to infrared radiation and having an inner wall surface coated with a material meeting the following two conditions:

$$e>0.5 \quad (1)$$

and $$de/dT<0.001 \quad (2)$$

wherein e is an emission factor and de/dT is a derivative with respect to time of the emission factor;

at least one temperature sensor, disposed to measure a temperature of the melt.

11. A sample vessel for thermal analysis of a melt according to claim 10, wherein at least one temperature sensor disposed to measure a temperature of the melt is an optical pyrometer.

12. An apparatus according to claim 10, further comprising:

a guide rod having a first end disposed at a measuring point substantially at a center of the melt and a second end disposed outside of the sample vessel, that portion of the guide rod disposed within the vessel being coated with a material meeting the following two conditions:

$$e>0.5 \quad (1)$$

and $$de/dT<0.001 \quad (2)$$

wherein e is an emission factor and de/dT is a derivative with respect to time of the emission factor.

13. A method according to claim 7, further comprising, using the measured temperatures to perform thermal analysis of the melt.

* * * * *